US008278832B2

(12) United States Patent
Hung et al.

(10) Patent No.: US 8,278,832 B2
(45) Date of Patent: Oct. 2, 2012

(54) DIMMER CIRCUIT OF LIGHT EMITTING DIODE AND ISOLATED VOLTAGE GENERATOR AND DIMMER METHOD THEREOF

(75) Inventors: Chen-Ming Hung, Hsinchu (TW); Maung Maung Win, Hsinchu (TW); Lan-Ting Hsu, Hsinchu (TW); Chih-Yuan Hsieh, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 261 days.

(21) Appl. No.: 12/623,449

(22) Filed: Nov. 23, 2009

(65) Prior Publication Data

US 2011/0037399 A1 Feb. 17, 2011

(30) Foreign Application Priority Data

Aug. 13, 2009 (TW) ..... 98127286 A

(51) Int. Cl.
*H05B 37/02* (2006.01)

(52) U.S. Cl. ..... 315/219; 315/294; 315/307

(58) Field of Classification Search ..... 315/219, 315/209 R, 224–226, 276, 287, 291, 294, 315/307

See application file for complete search history.

(56) References Cited

U.S. PATENT DOCUMENTS

| | | | | |
|---|---|---|---|---|
| 6,839,247 | B1 * | 1/2005 | Yang et al. | 363/21.11 |
| 8,013,544 | B2 * | 9/2011 | Negrete et al. | 315/307 |
| 2007/0182347 | A1 * | 8/2007 | Shteynberg et al. | 315/312 |
| 2008/0018261 | A1 * | 1/2008 | Kastner | 315/192 |
| 2008/0278092 | A1 * | 11/2008 | Lys et al. | 315/247 |
| 2010/0019692 | A1 * | 1/2010 | Kimura | 315/294 |
| 2010/0213857 | A1 * | 8/2010 | Fan | 315/186 |
| 2010/0320934 | A1 * | 12/2010 | Liu et al. | 315/294 |
| 2011/0012530 | A1 * | 1/2011 | Zheng et al. | 315/294 |
| 2011/0025217 | A1 * | 2/2011 | Zhan et al. | 315/219 |

* cited by examiner

*Primary Examiner* — Tung X Le
(74) *Attorney, Agent, or Firm* — Jianq Chyun IP Office

(57) ABSTRACT

An isolated configuration dimmer circuit of a light emitting diode (LED) applied to a conventional triac dimmer and a dimmer method are provided. When a dimmer phase angle of the triac dimmer is regulated, a second side winding of a transformer of the isolated configuration produces a pulse width corresponding to a modulated alternating current (AC) voltage, so as to regulate the pulse width of a driving signal output by the second side winding of the transformer. In addition, the dimmer circuit regulates the magnitude of a current flowing through the light emitting diode (LED) according to the pulse width corresponding to the modulated AC voltage. Accordingly, the dimmer circuit regulates the pulse width and the magnitude of the current flowing through the LED according to the dimmer phase angle of the triac dimmer. Therefore, a dimmer range of the LED can be increased.

25 Claims, 17 Drawing Sheets

DIMMER CIRCUIT OF LIGHT EMITTING DIODE AND ISOLATED VOLTAGE GENERATOR AND DIMMER METHOD THEREOF

CROSS-REFERENCE TO RELATED APPLICATION

This application claims the priority benefit of Taiwan application serial no. 98127286, filed on Aug. 13, 2009. The entirety of the above-mentioned patent application is hereby incorporated by reference herein and made a part of specification.

BACKGROUND OF THE INVENTION

1. Field of the Invention

The present invention relates to a dimmer circuit. More particularly, the present invention relates to a dimmer circuit of a light-emitting diode (LED) and an isolated voltage generator and a dimmer method thereof.

2. Description of Related Art

Light emitting diodes (LEDs) have advantages of small size, power-saving and high durability, and as fabrication processes thereof become mature, price of the LEDs decreases. Therefore, it is popular to use the LEDs as light source products. Moreover, since the LED has features of low-operating voltage (only 1.5-3V), initiative light-emitting, and having a certain brightness, wherein the brightness can be adjusted by voltage or current, and has features of impact resistance, anti-vibration and long lifespan (100,000 hours), the LED is widely used to various terminal equipments, such as vehicle headlamps, traffic lights, text displays, billboards and large screen video displays, and domains such as general level architectural lighting and liquid crystal display (LCD) backlight, etc.

FIG. 1A is a system schematic diagram illustrating a conventional dimmer circuit of an LED. Referring to FIG. 1A, the dimmer circuit 100 is a basic circuit that a buck constant current control chip LM3445 is applied for dimming an LED, and a technical manual of the chip LM3445 can be referred for a detailed circuit operation of the dimmer circuit 100. In the dimmer circuit 100, an alternating current (AC) signal VAC is first modulated by a triac dimmer according to a dimmer phase angle thereof, and then a pulse width detection circuit 110 fetches a modulation signal Vac modulated by the triac dimmer. Then, a low-pass filter circuit 120 converts a pulse width of the modulation signal Vac into a direct current (DC) voltage. The chip LM3445 controls a switch signal of a transistor 130 according to the DC voltage, so as to control a current magnitude of a load current ILED used for driving the LED.

FIG. 1B is a waveform diagram of the modulation signal and the load current of FIG. 1A. Referring to FIG. 1A and FIG. 1B, when the dimmer angle of the triac dimmer is increased, the pulse width of the modulation signal Vac is relatively narrowed. When the pulse width of the modulation signal Vac is narrowed, the DC voltage received by the chip LM3445 is decreased. Now, the chip LM3445 controls the transistor 130 to decrease the current magnitude of the load current ILED, and the brightness of the LED is darkened as the current magnitude of the load current ILED is decreased.

According to the circuit of FIG. 1A, ground points of the dimmer circuit 100 are all the same, i.e. the dimmer circuit 100 is an un-isolated dimmer circuit. Moreover, a dimmer method of the dimmer circuit 100 is to adjust the current magnitude of the load current ILED.

SUMMARY OF THE INVENTION

The present invention is directed to an isolated voltage generator, in which a second side winding of a transformer produces a pulse width corresponding to a modulated alternating current (AC) voltage, so as to regulate a pulse width of a driving signal output by the second side winding of the transformer.

The present invention is directed to a dimmer circuit of a light-emitting diode (LED), and a dimmer method thereof, in which a pulse width of a current flowing through the LED is regulated according to a dimmer phase angle. Moreover, a current magnitude of the current flowing through the LED is adjusted according to the dimmer phase angle.

The present invention provides an isolated voltage generator adapted to an LED dimmer circuit, wherein the LED dimmer circuit has a triac dimmer. The isolated voltage generator includes a rectifier, a controller, a transformer, a switch, a voltage divider and a first resistor. The rectifier receives a first voltage modulated by the triac dimmer. The controller has an input terminal, a driving output terminal, a feedback terminal and a current sensing terminal. The controller generates a control signal according to voltages received by the feedback terminal and the current sensing terminal, and outputs the control signal through the driving output terminal. The transformer has a first side winding, a second side winding and a third side winding, wherein a first terminal of the first side winding is coupled to the rectifier, a first terminal of the second side winding outputs a driving signal, a second terminal of the second side winding is coupled to a second ground voltage, and the third side winding is coupled between the input terminal of the controller and a first ground voltage. The switch has a control terminal, a first terminal and a second terminal, the control terminal of the switch is coupled to the driving output terminal of the controller, the first terminal of the switch is coupled to a second terminal of the first side winding, and the second terminal of the switch is coupled to the current sensing terminal of the controller. The voltage divider is coupled among a first terminal of the third side winding of the transformer, the feedback terminal of the controller and the first ground voltage for providing a divided voltage to the feedback terminal of the controller. The first resistor is coupled between the current sensing terminal of the controller and the first ground voltage.

The present invention provides an LED dimmer circuit including a triac dimmer, an isolated voltage generator, and a current controller. The triac dimmer receives a first voltage, and modulates the first voltage according to a dimmer phase angle. The isolated voltage generator is coupled to the triac dimmer, and generates a driving signal according to the modulated first voltage, so as to drive at least one LED, wherein the first voltage and a voltage forming the driving signal are mutually isolated. The current controller controls a current flowing through the LED according to a regulation signal.

The present invention provides a dimmer method of an LED, which is adapted to an LED dimmer circuit. A triac dimmer of the LED dimmer circuit modulates an AC voltage according to a dimmer phase angle, an isolated voltage generator of the LED dimmer circuit generates a driving signal according to the modulated AC voltage, so as to drive at least one LED, and a current controller of the LED dimmer circuit controls a current flowing through the LED. In the dimmer method, when the dimmer phase angle is decreased, a pulse width of the modulated AC voltage is increased, and a pulse width of the driving signal is correspondingly increased, so as to increase a pulse width of the current flowing through the LED, wherein a voltage forming the modulated AC voltage and a voltage forming the driving signal are mutually isolated. When the dimmer phase angle is increased, the pulse width of the modulated AC voltage is decreased, and the pulse width of the driving signal is correspondingly decreased, so as to decrease the pulse width of the current flowing through the LED.

According to the above descriptions, in the isolated voltage generator of the present invention, the pulse width of the modulation signal is fed back through the transformer having three sides, and the pulse width of the driving signal and the current of the driving signal are regulated according to the pulse width of the modulation signal. In the LED dimmer circuit and the dimmer method thereof, the pulse width and the magnitude of the current flowing through the LED string are regulated according to the dimmer phase angle of the triac dimmer. By such means, a dimmer range of the LED can be increased.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
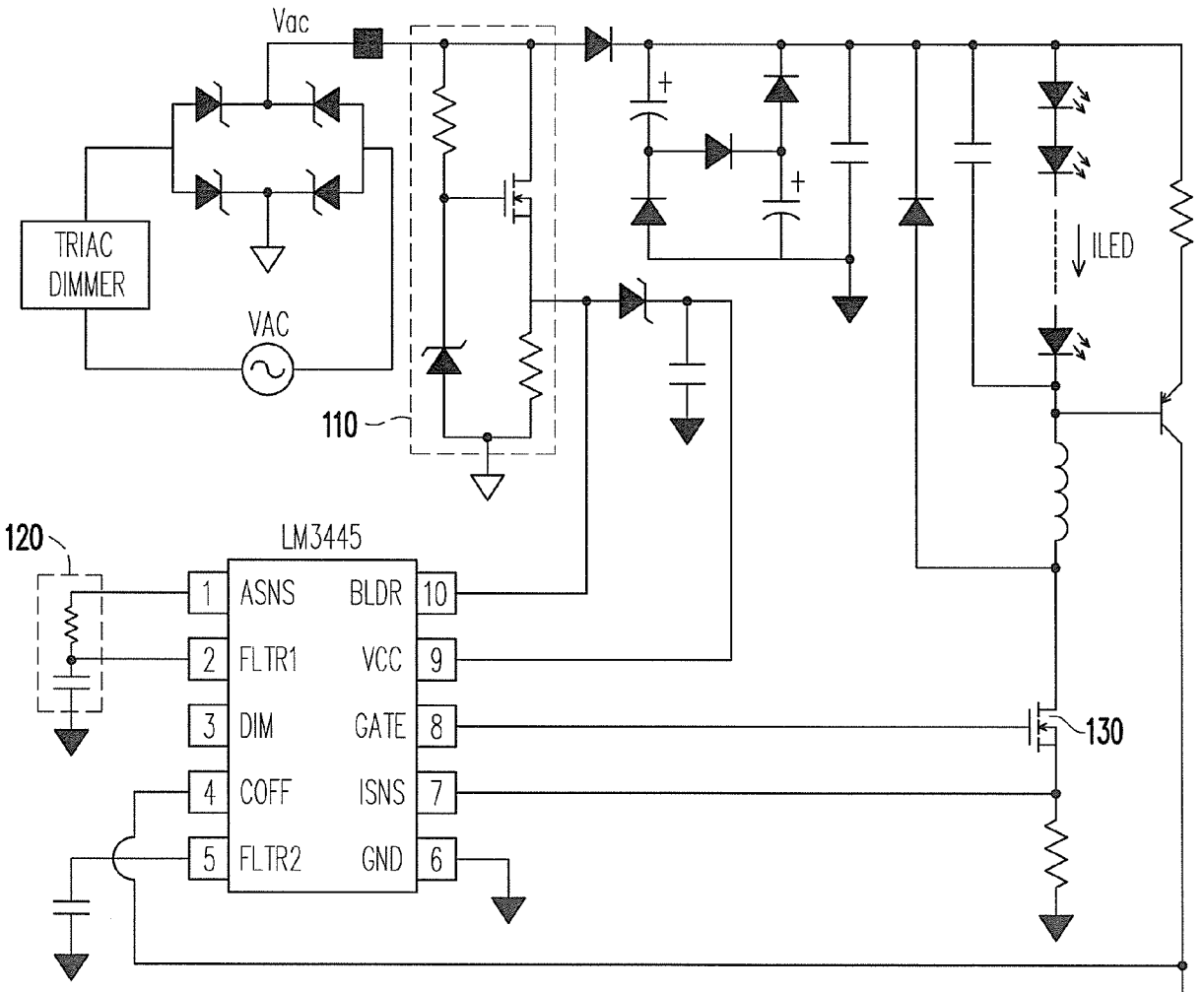
FIG. 1A (RELATED ART)
FIG. 1A is a system schematic diagram illustrating a conventional dimmer circuit of an LED.
Figure 1B:
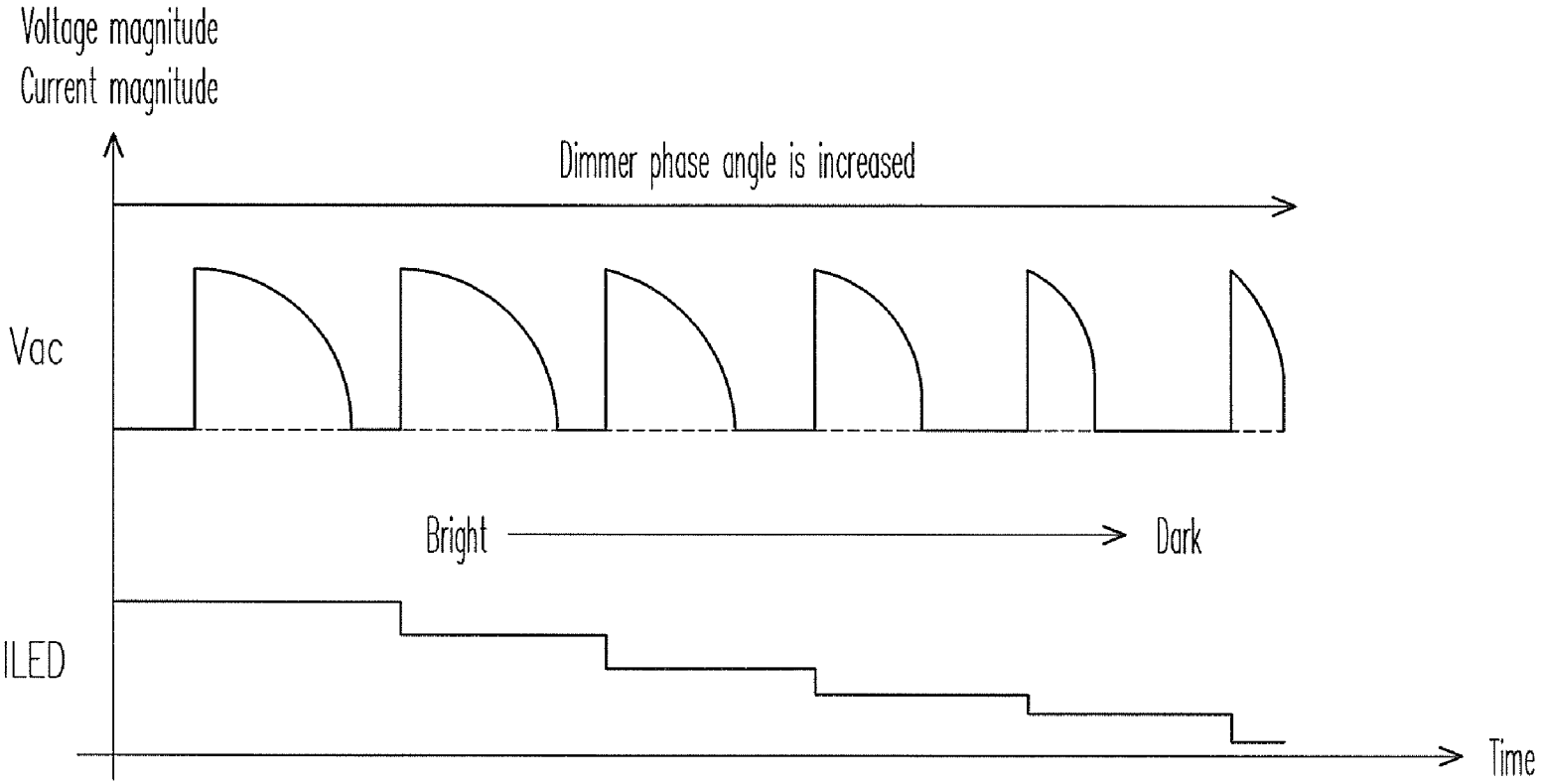
FIG. 1B (RELATED ART)
FIG. 1B is a waveform diagram of a modulation signal and a load current of FIG. 1A.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
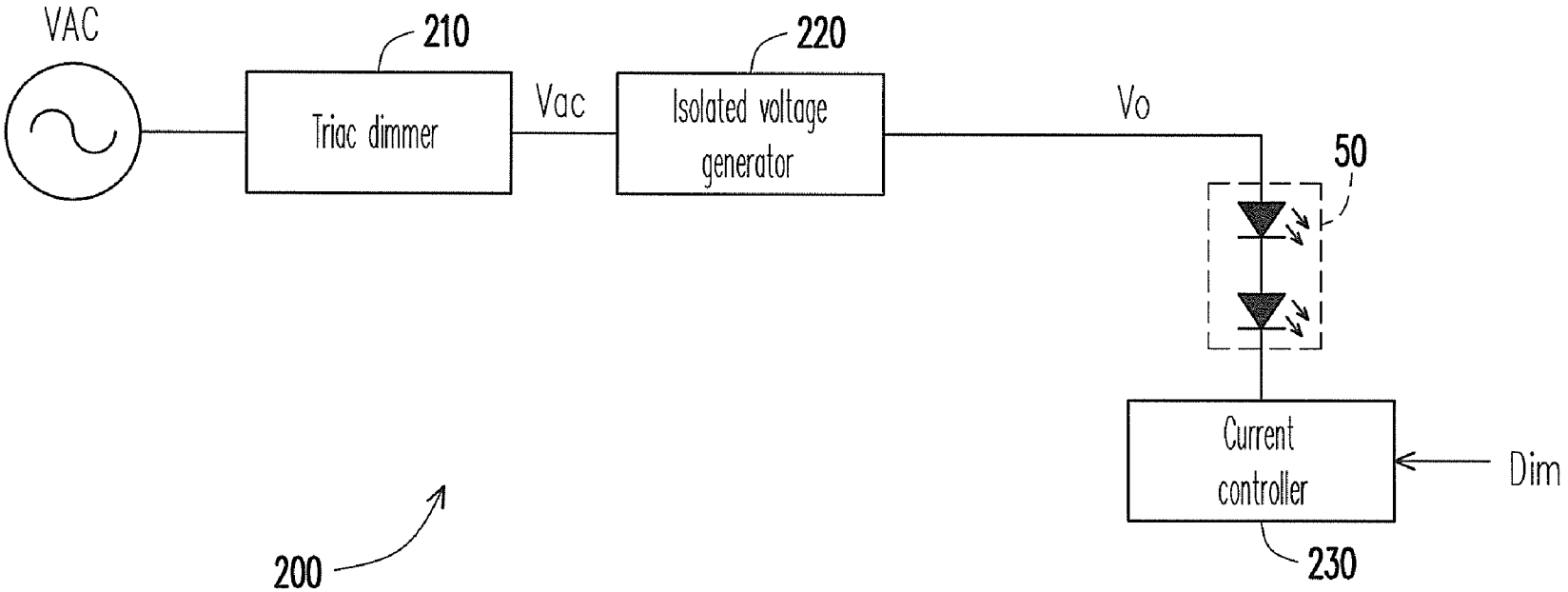
FIG. 2A is a system schematic diagram illustrating a dimmer circuit according to an embodiment of the present invention.

FIG. 2A is a system schematic diagram illustrating a dimmer circuit according to an embodiment of the present invention. Referring to FIG. 2A, the dimmer circuit 200 includes a triac dimmer 210, an isolated voltage generator 220 and a current controller 230, wherein the dimmer circuit 200 is used for driving and dimming an LED. The triac dimmer 210 receives an alternating current (AC) voltage VAC, and modulates the AC voltage VAC according to a predetermined dimmer phase angle, so as to regulate a pulse width of the modulated AC voltage VAC according to the dimmer phase angle. The modulated AC voltage VAC is referred to as a modulation signal Vac, wherein the AC voltage VAC can be a local AC voltage.

The isolated voltage generator 220 is coupled to the triac dimmer 210 for generating a driving signal Vo according to the modulation signal Vac, so as to drive an LED string 50, wherein the LED string 50 is illustrated as an example, and actually the LED string 50 can include at least one LED, namely, the LED 50 can be one or more than two LEDs. It should be noticed that a voltage forming the modulation signal Vac and a voltage forming the driving signal Vo are mutually isolated. Namely, a current loop forming the modulation signal Vac and a current loop forming the driving signal Vo have no common path. Moreover, the isolated voltage generator 220 may have a flyback structure or a forward structure, which is determined according to a current magnitude of the driving signal Vo and the used devices. The current controller 230 controls a magnitude of a current flowing through the LED string 50 according to a regulation signal Dim, wherein the current controller 230 can be implemented by a buck converter, a boost converter or a buck-boost converter, and according to a type of the current controller 230, the regulation signal Dim can be a DC voltage or a pulse signal.

Figure 2B:
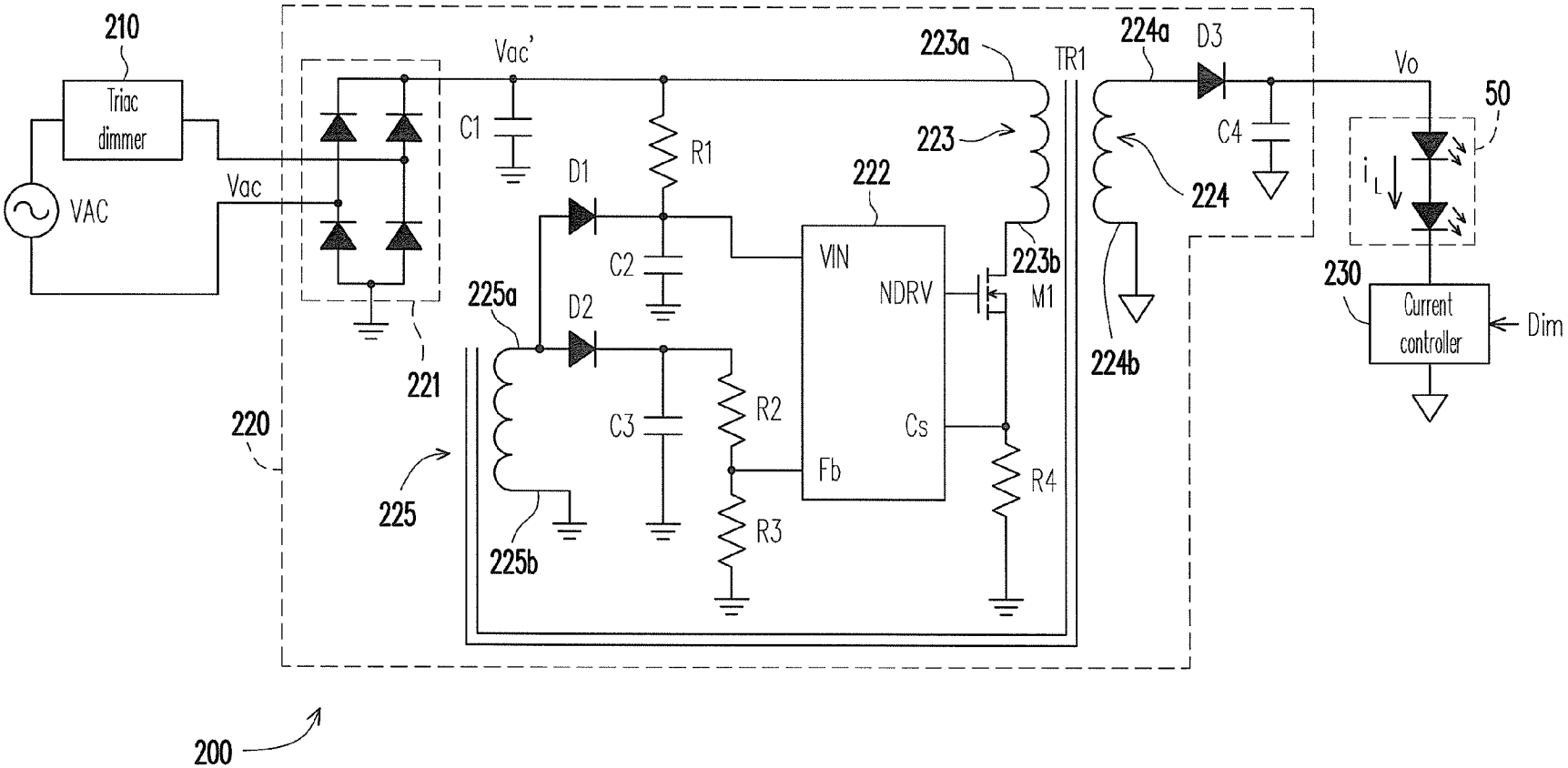
FIG. 2B is a circuit diagram of a dimmer circuit of FIG. 2A.

FIG. 2B is a circuit diagram of the dimmer circuit of FIG. 2A. Referring to FIG. 2B, in the present embodiment, the isolated voltage generator 220 includes a rectifier 221, a controller 222, a transformer TR1, capacitors C1, C2, C3 and C4, resistors R1, R2, R3 and R4, diodes D1, D2 and D3, and a transistor M1. The rectifier 221 receives and rectifies the modulation signal Vac to generate a modulation signal Vac', wherein the rectifier 221 is, for example, a bridge rectifier, though the present invention is not limited thereto.

The capacitor C1 is coupled between the rectifier 221 and a first ground voltage. The resistor R1 is coupled between the rectifier 221 and an input terminal VIN of the controller 222. The capacitor C2 is coupled between the input terminal VIN of the controller 222 and the first ground voltage. The diode D1 is coupled between a first terminal 225*a* of a third side winding 225 of the transformer TR1 and the input terminal VIN of the controller 222. A second terminal 225*b* of the third side winding 225 of the transformer TR1 is coupled to the first ground voltage. The diode D2 is coupled between the first terminal 225*a* of the third side winding 225 of the transformer TR1 and the resistor R2.

The capacitor C3 is coupled between the first terminal 225*a* of the third side winding 225 of the transformer TR1 and the first ground voltage. The resistor R2 is coupled between the first terminal 225*a* of the third side winding 225 of the transformer TR1 and a feedback terminal Fb of the controller 222. The resistor R3 is coupled between the feedback terminal Fb of the controller 222 and the first ground voltage. Wherein, the resistors R2 and R3 can be regarded as a voltage divider for dividing a voltage of the third side winding 225 of the transformer TR1, so as to provide a divided voltage to the feedback terminal Fb of the controller 222.

A first terminal 223*a* of a first side winding 223 of the transformer TR1 is coupled to the rectifier 221. A drain (i.e. a first terminal) of the transistor M1 is coupled to a second terminal 223*b* of the first side winding 223 of the transformer TR1, a source (i.e. a second terminal) of the transistor M1 is coupled to a current sensing terminal Cs of the controller 222, and a gate (i.e. a control terminal) of the transistor M1 is coupled to a driving output terminal NDRV of the controller 222, wherein the transistor M1 is, for example, a metal-oxide-semiconductor (MOS) field-effect transistor, and the transistor M1 can be regarded as a switch in the circuit. The resistor R4 is coupled between the current sensing terminal Cs of the controller 222 and the first ground voltage.

A first terminal 224*a* of a second side winding 224 of the transformer TR1 is coupled to an anode of the diode D3, and a second terminal 224*b* of the second side winding 224 of the transformer TR1 is coupled to a second ground voltage. A cathode of the diode D3 is coupled to the LED string 50. The capacitor C4 is coupled between the cathode of the diode D3 and the second ground voltage. Whether or not the controller 222 is activated is determined according to a voltage received by the input terminal VIN of the controller 222, and the controller 222 generates a control signal according to voltages received by the feedback terminal Fb and the current sensing terminal Cs, and outputs the control signal to the gate of the transistor M1 through the driving output terminal NDRV, so as to control a conduction of the transistor M1. The capacitors C1-C3 are used for filtering in the circuit, and the capacitor C4 has a great capacitance, so as to regulate the driving signal Vo.

Figure 2C:
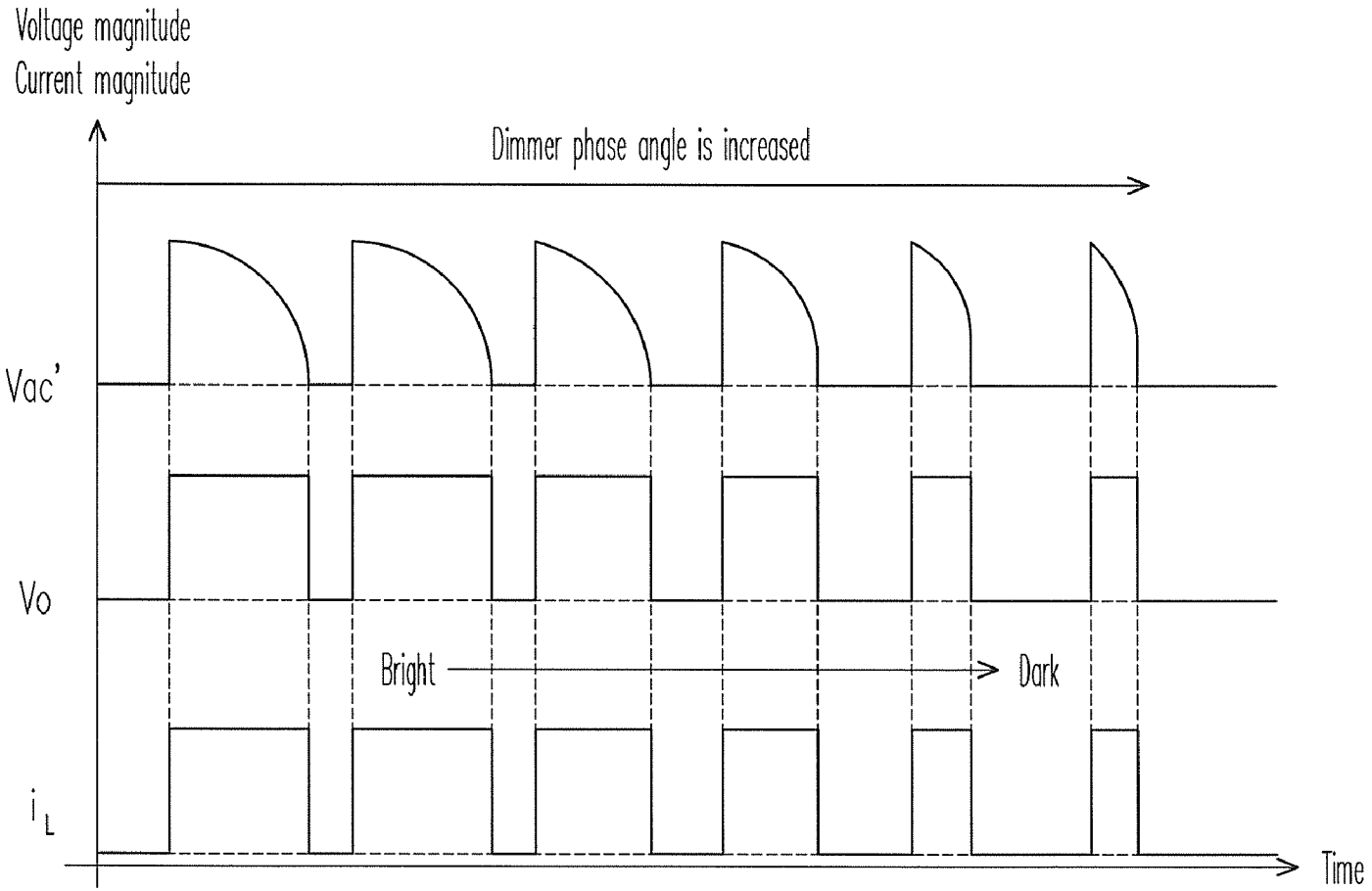
FIG. 2C and FIG. 2D are waveform diagrams of a modulation signal Vac', a driving signal Vo and a current $i_L$ of a dimmer circuit of FIG. 2B.

FIG. 2C is a waveform diagram of the modulation signal Vac', the driving signal Vo and a current $i_L$ of the dimmer circuit of FIG. 2B. Referring to FIG. 2B and FIG. 2C, when the modulation signal Vac' forms a pulse, the input terminal VIN of the controller 222 receives a voltage through the resistor R1, and the controller 222 is activated. Now, the pulse of the modulation signal Vac' is also fed back to the feedback terminal Fb of the controller 222 through the third side winding 225 of the transformer TR1. The controller 222 generates a control voltage according to the voltage received by the feedback terminal Fb and a voltage of the current sensing terminal Cs, so as to control a conducting time of the transistor M1. In other words, when the voltage received by the feedback terminal Fb is increased, the voltage of the current sensing terminal Cs is decreased, and the controller 222 can reduce the conducting time of the transistor M1 through a feedback mechanism, so as to decrease the current flowing through the first side winding 223. Conversely, when the voltage of the feedback terminal Fb is decreased, the voltage of the current sensing terminal Cs is increased, and the controller 222 can increase the conducting time of the transistor M1 through the feedback mechanism, so as to increase the current flowing through the first side winding 223, so that the voltage of the feedback terminal Fb is further increased to reach a balance. Therefore, the current flowing through the first side winding 223 of the transformer TR1 is approximately maintained to a fixed value through the transistor M1, so that energy transmitted through coils of the transformer TR1 can be maintained fixed, and the voltage of the driving signal Co can be approximately maintained to a certain voltage value.

When the modulation signal Vac' does not form the pulse, no current flows through the first side winding 223 of the transformer TR1, i.e. the coils of the transformer TR1 does not transmit energy, so that the feedback terminal Fb of the controller 222 cannot receive a voltage. Now, the control voltage generated by the controller 222 controls the transistor M1 to increase the conducting time. Moreover, the voltage of the driving signal Vo is closed to the second ground voltage. According to the above descriptions, the voltage of the driving signal Vo is maintained to a certain voltage value when the modulation signal Vac' forms the pulse, and is closed to the second ground voltage when the modulation signal Vac' does not form the pulse. Namely, the driving signal Vo can form a pulse according to the modulation signal Vac', and a pulse width of the driving signal Vo is closed to that of the modulation signal Vac'.

Since the modulation signal Vac' is obtained by modulating and rectifying the AC voltage VAC via the triac dimmer 210 and the rectifier 221, when the dimmer phase angle of the triac dimmer 210 is increased, a conducting time of the triac dimmer 210 is shortened, so that the pulse width of the modulation signal Vac' is narrowed, and the pulse width of the driving signal Vo is correspondingly narrowed, wherein regulation of the dimmer phase angle of the triac dimmer 210 is described later. When the pulse width of the driving signal Vo is narrowed, a pulse width of the current $i_L$ flowing through the LED string 50 is correspondingly narrowed. Therefore, an average current flowing through the LED string 50 is decreased, which may lead to a fact that a light-emitting brightness of the LED string 50 is darkened.

Figure 2D:
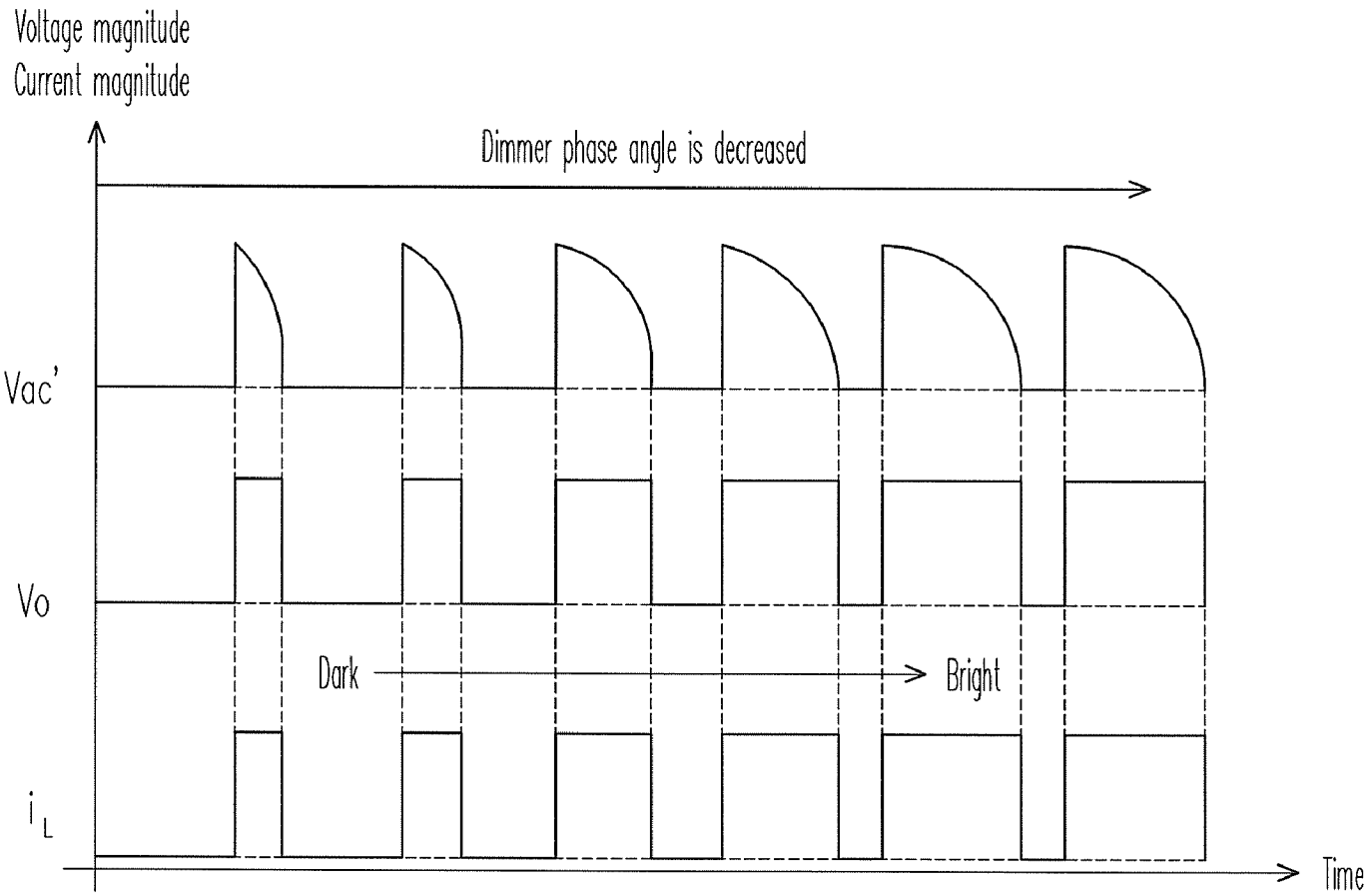

FIG. 2D is a waveform diagram of the modulation signal Vac', the driving signal Vo and the current $i_L$ of the dimmer circuit of FIG. 2B. Referring to FIG. 2C and FIG. 2D, when the dimmer phase angle of the triac dimmer 210 is decreased, the conducting time of the triac dimmer 210 is increased, so that the pulse width of the modulation signal Vac' is broadened, and the pulse width of the driving signal Vo is correspondingly broadened. When the pulse width of the driving signal Vo is broadened, the pulse width of the current $i_L$ flowing through the LED string 50 is correspondingly broadened. Therefore, the average current flowing through the LED string 50 is increased, which may lead to a fact that the light-emitting brightness of the LED string 50 is increased.

The controller 222 can be implemented by a buck constant current control chip MAX16801, wherein the input terminal VIN of the controller 222 corresponds to a pin IN of the chip MAX16801, the driving output terminal NDRV of the controller 222 corresponds to a pin NDRV of the chip MAX16801, the feedback terminal Fb of the controller 222 corresponds to a pin DIM/Fb of the chip MAX16801, and the current sensing terminal Cs of the controller 222 corresponds to a pin Cs of the MAX16801.

Figure 2E:
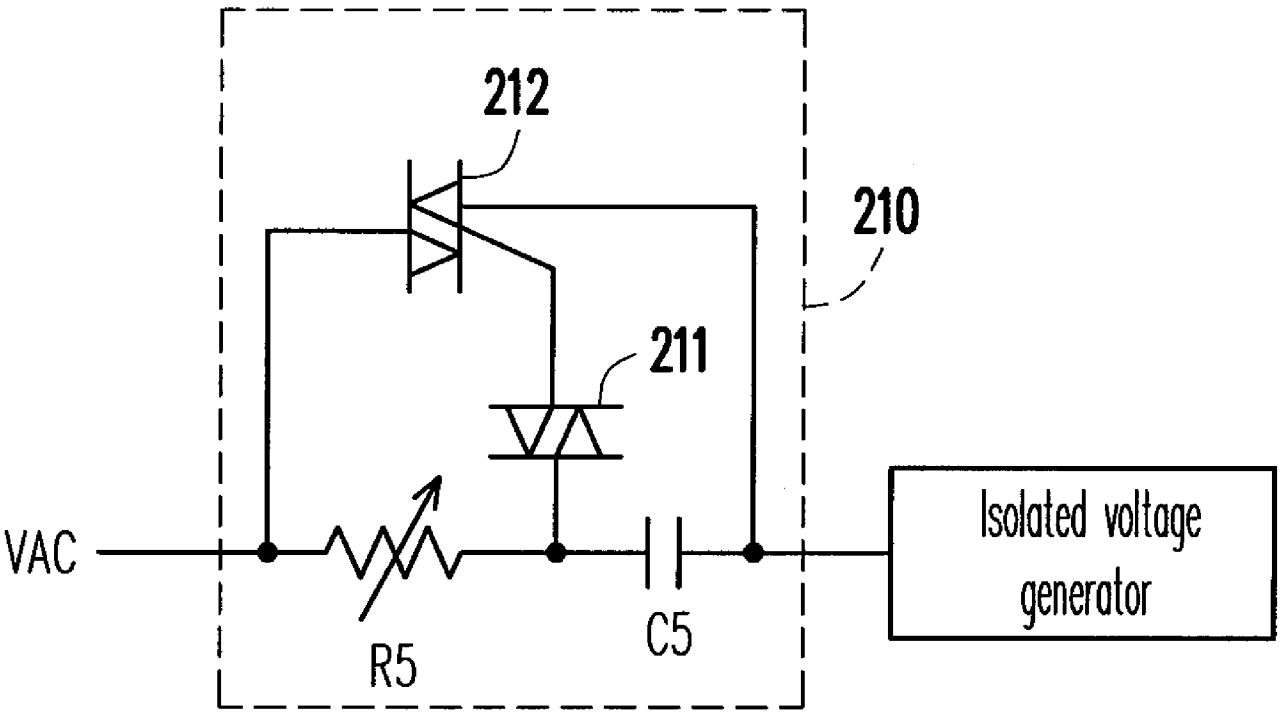
FIG. 2E is a circuit diagram illustrating a triac dimmer of FIG. 2B.

FIG. 2E is a circuit diagram illustrating the triac dimmer of FIG. 2B. Referring to FIG. 2E, the triac dimmer 210 includes a resistor R5, a capacitor C5, a diode for alternating current (DIAC) 211 and a tri-electrode AC switch (TRIAC) 212. When a voltage of the capacitor C5 triggers a threshold value of the DIAC 211, the DIAC 211 is conducted, so that the TRIAC 212 receives a voltage and is conducted. Since the capacitor C5 is connected to the resistor R5 in serial, a charging speed of the capacitor C5 is determined by a RC constant of the capacitor C5 and the resistor R5. In other words, the higher a resistance of the resistor R5 is, the longer the time for charging the capacitor C5 to the threshold value is, i.e. the higher a conducting phase of the TRIAC 212 is, so that the conducting time of the TRIAC 212 is shortened. Conversely, the lower the resistance of the resistor R5 is, shorter the time for charging the capacitor C5 to the threshold value is, i.e. the lower the conducting phase of the TRIAC 212 is, so that the conducting time of the TRIAC 212 is prolonged. Therefore, by adjusting the resistance of the resistor R5, the conducting phase of the TRIAC 212 can be adjusted, i.e. the dimmer phase angle of the triac dimmer 210 can be adjusted.

Figure 2F:
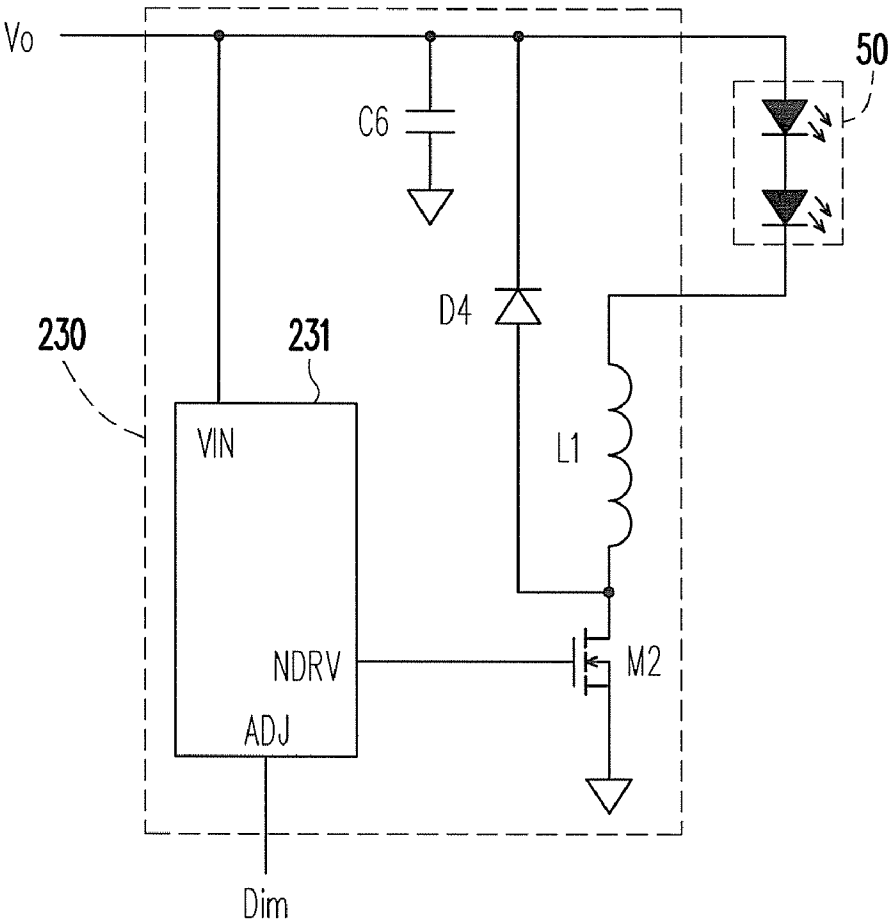
FIG. 2F is a circuit diagram illustrating a current controller coupled to an LED string of FIG. 2B.

FIG. 2F is a circuit diagram illustrating the current controller coupled to the LED string of FIG. 2B. Referring to FIG. 2F, in the present embodiment, the current controller 230 is, for example, a buck converter, and the regulation signal Dim is assumed to be a DC voltage. The current controller 230 includes a voltage controller 231, a transistor M2, an inductor L1, a diode D4 and a capacitor C6. An input terminal VIN of the voltage controller 231 is coupled to the isolated voltage generator 220 for receiving the driving signal Vo, an signal adjusting terminal ADJ of the voltage controller 231 receives the regulation signal Dim. The voltage controller 231 regulates a voltage of a driving output terminal NDRV thereof according to the regulation signal Dim.

A gate of the transistor M2 is coupled to the driving output terminal NDRV of the voltage controller 231, a source of the transistor M2 is coupled to the second ground voltage, and a drain of the transistor M2 is coupled to one end of the inductor L1. Whether the transistor M2 is conducted is determined according to the voltage of the driving output terminal NDRV of the voltage controller 231. Another end of the inductor L1 is coupled to the LED string 50. The diode D4 is coupled between the isolated voltage generator 220 and the drain of the transistor M2. Wherein, the voltage controller 230 can be implemented by a voltage-adjustable regulator, in which the regulation signal Dim determines the voltage of the driving output terminal NDRV, so as to control a magnitude of the current $i_L$ flowing through the LED string 50.

Figure 3A:
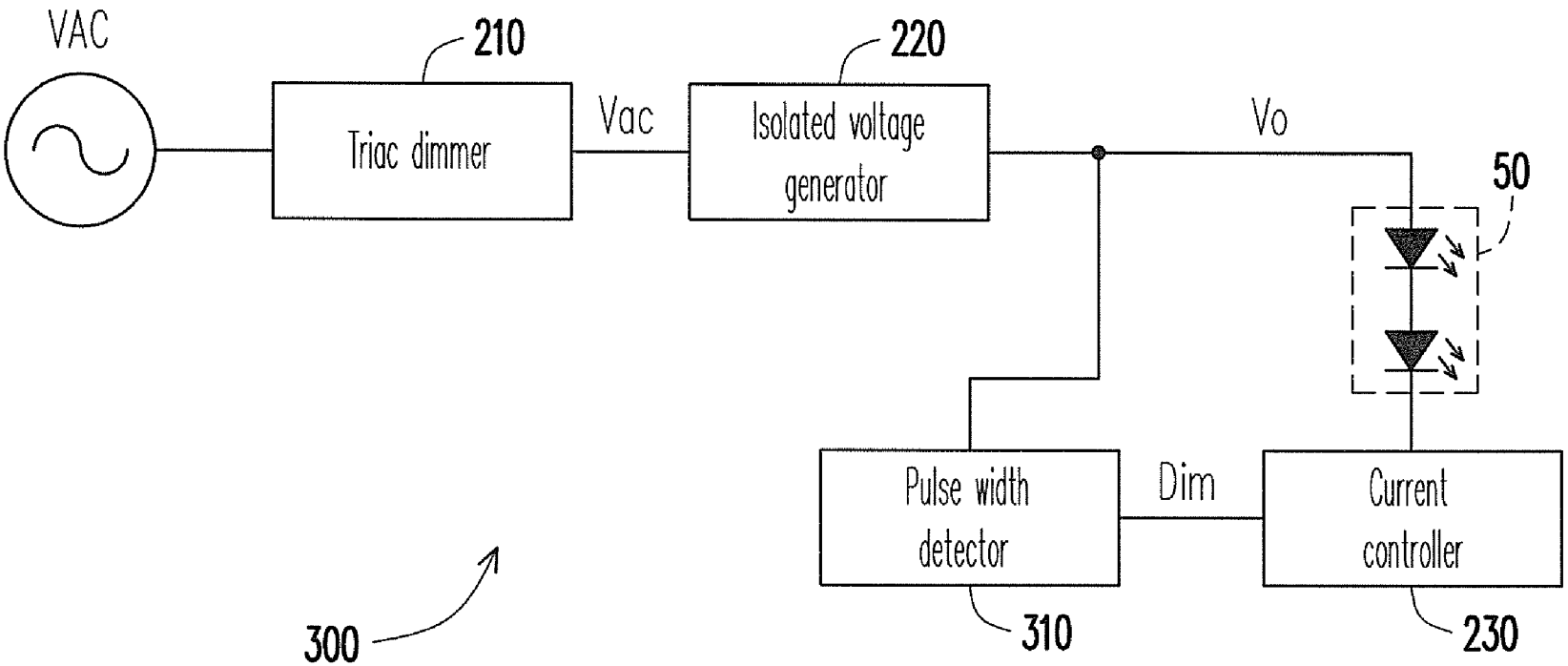
FIG. 3A is a system schematic diagram illustrating a dimmer circuit according to another embodiment of the present invention.

FIG. 3A is a system schematic diagram illustrating a dimmer circuit according to another embodiment of the present invention. Referring to FIG. 2A and FIG. 3A, a difference there between is that the dimmer circuit 300 includes a pulse width detector 310. The pulse width detector 310 is coupled to the isolated voltage generator 220 for detecting the pulse width of the driving signal Vo. Moreover, the pulse width detector 310 generates the regulation signal Dim according to the pulse width of the driving signal Vo, so as to regulate the magnitude of the current flowing through the LED string 50 through the current controller 230.

Figure 3B:
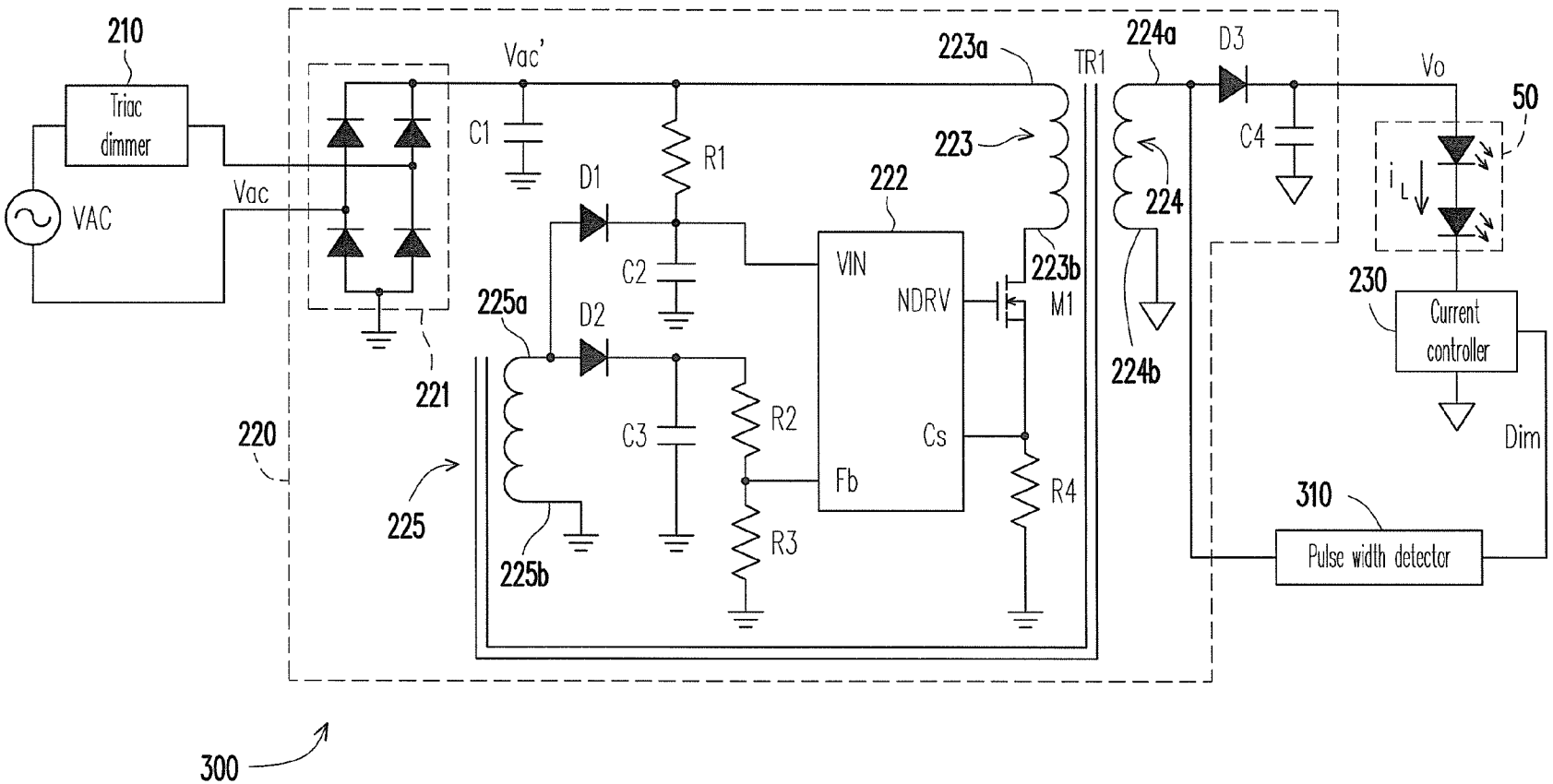
FIG. 3B is a circuit diagram illustrating a dimmer circuit of FIG. 3A.

FIG. 3B is a circuit diagram illustrating the dimmer circuit of FIG. 3A. Referring to FIG. 2B and FIG. 3B, a difference there between lies in the pulse width detector 310. The pulse width detector 310 is coupled between the first terminal 224*a* of the second side winding 224 of the transformer TR1 and the current controller 230. Since the pulse width of the driving signal Vo is closed to the pulse width of the modulation signal Vac', the pulse width detector 310 can obtain the pulse width of the modulation signal Vac' by detecting the pulse width of the driving signal Vo. Then, the magnitude of the current $i_L$ flowing through the LED string 50 is regulated according to the pulse width of the modulation signal Vac'.

Figure 3C:
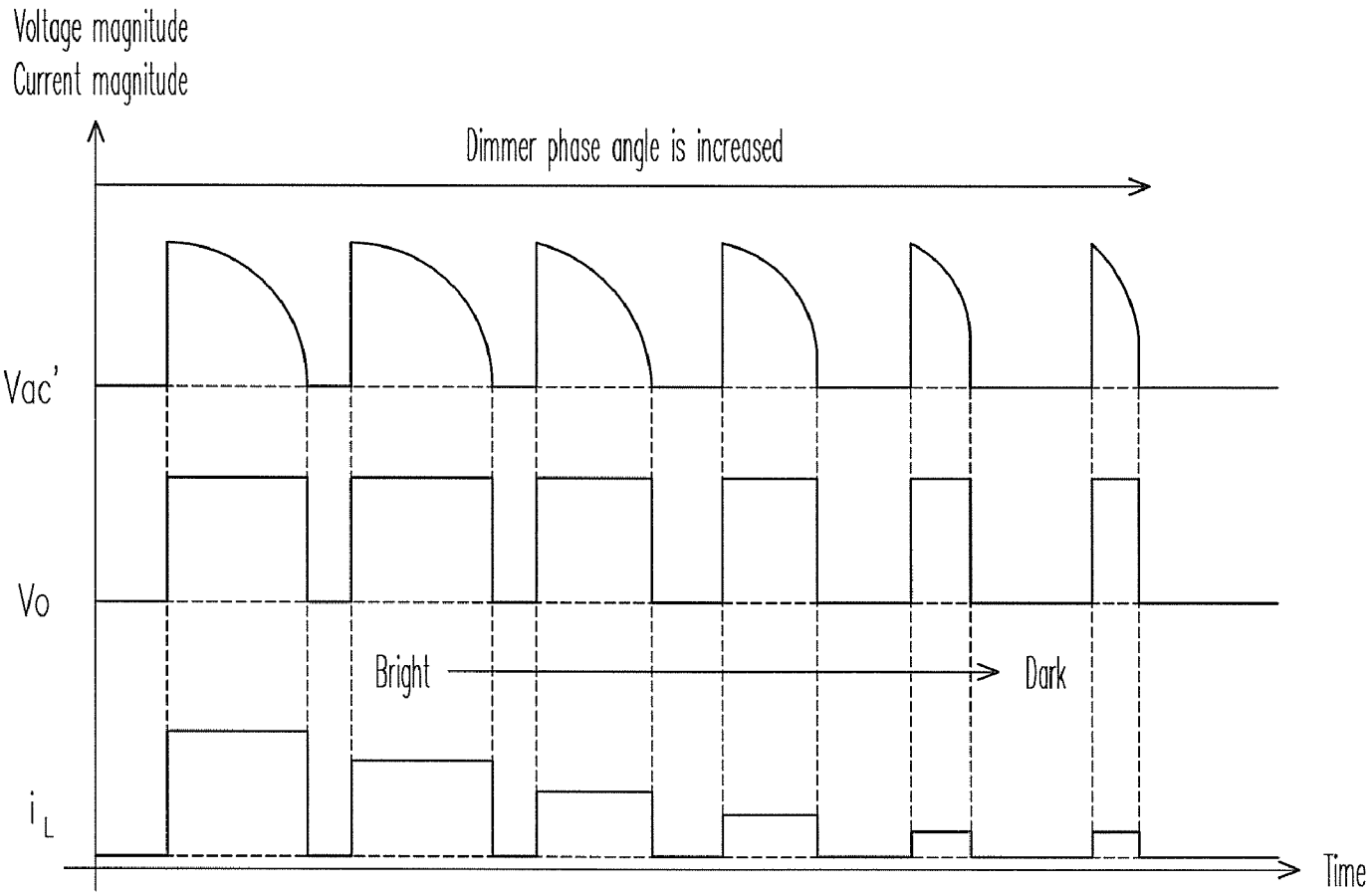
FIG. 3C and FIG. 3D are waveform diagrams of a modulation signal Vac', a driving signal Vo and a current $i_L$ of a dimmer circuit of FIG. 3B.
Figure 3D:
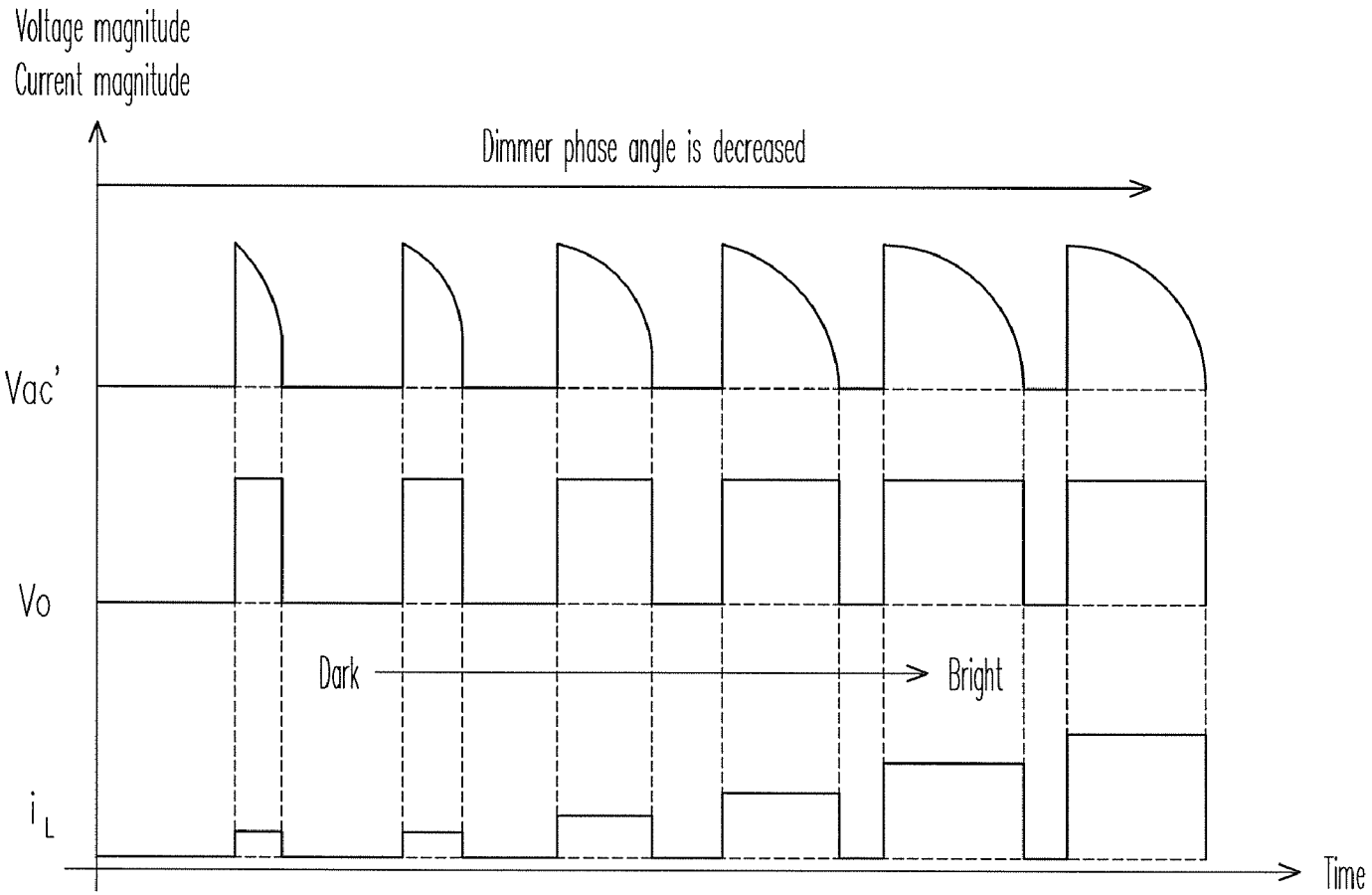

FIG. 3C and FIG. 3D are waveform diagrams of the modulation signal Vac', the driving signal Vo and the current $i_L$ of the dimmer circuit of FIG. 3B. Referring to FIG. 3B and FIG. 3C first, when the dimmer phase angle of the triac dimmer 210 is increased, the pulse width of the modulation signal Vac' is narrowed, and the pulse width of the driving signal Vo is correspondingly narrowed. When the pulse width of the driving signal Vo is narrowed, the pulse width of the current $i_L$ flowing through the LED string 50 is also narrowed. Moreover, the pulse width detector 310 can generate the regulation signal Dim according to the pulse width of the modulation signal Vac', so as to control the current controller 230 to decrease the magnitude of the current $i_L$ flowing through the LED string 50. Therefore, the average current flowing through the LED string 50 can be decreased, so that the light-emitting brightness of the LED string 50 is darkened.

Referring to FIG. 3B and FIG. 3D, when the dimmer phase angle of the triac dimmer 210 is decreased, the pulse width of the modulation signal Vac' is broadened, and the pulse width of the driving signal Vo is correspondingly broadened. When the pulse width of the driving signal Vo is broadened, the pulse width of the current $i_L$ flowing through the LED string 50 is also broadened. Moreover, the pulse width detector 310 can generate the regulation signal Dim according to the pulse width of the modulation signal Vac', so as to control the current controller 230 to increase the magnitude of the current $i_L$ flowing through the LED string 50. Therefore, the average current flowing through the LED string 50 can be increased, so that the light-emitting brightness of the LED string 50 is increased. By such means, the dimmer circuit 300 can dim the LED string 50, and a dimmer range can be increased by adjusting the pulse width and the magnitude of the current flowing through the LED string 50.

Figure 3E:
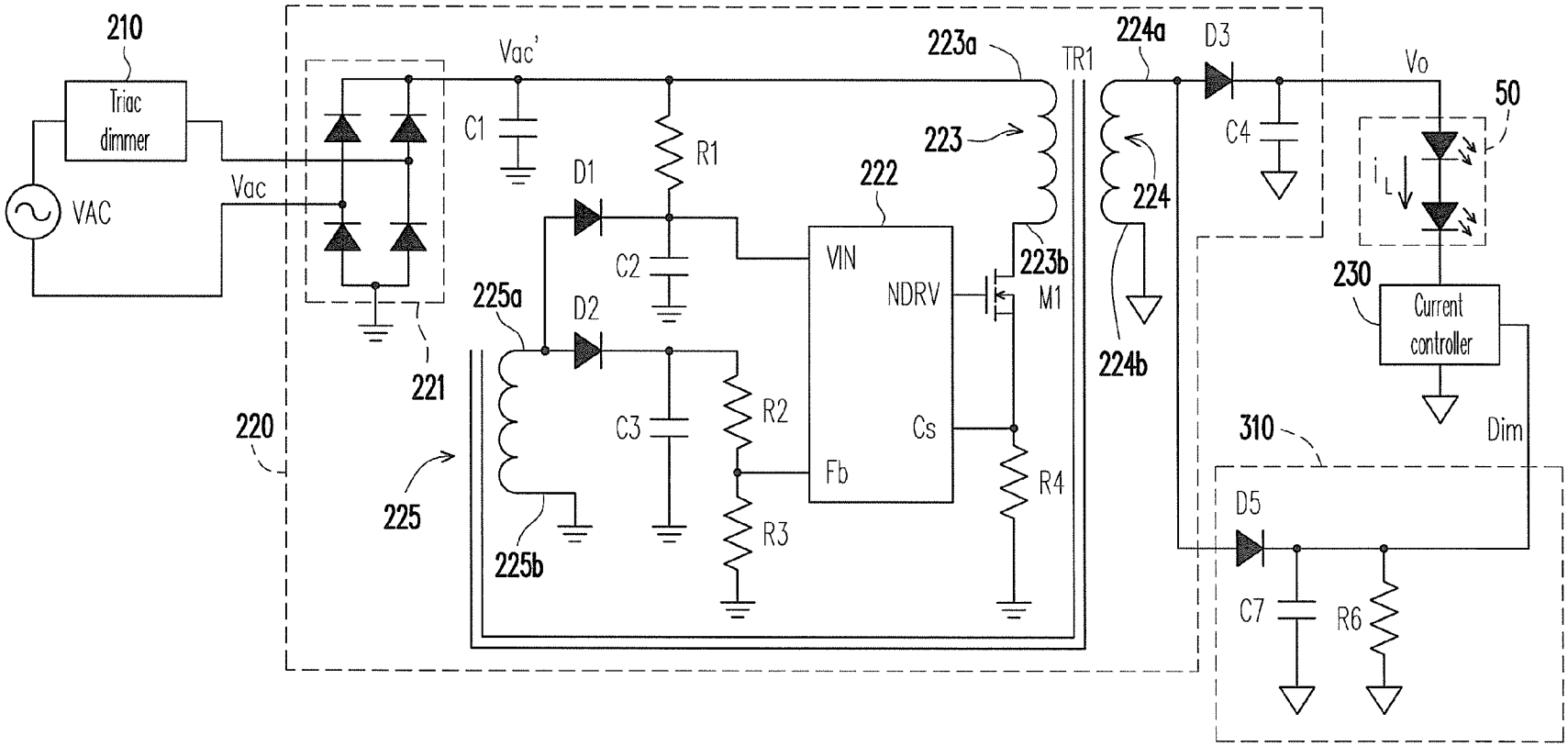
FIG. 3E is another circuit diagram illustrating a dimmer circuit of FIG. 3A.

FIG. 3E is another circuit diagram illustrating the dimmer circuit of FIG. 3A. Referring to FIG. 3B and FIG. 3E, a difference there between is that the pulse width detector 310 includes a diode D5, a capacitor C7 and a resistor R6. The diode D5 is coupled between the first terminal 224*a* of the second side winding 224 of the transformer TR1 and a first terminal of the capacitor C7. A second terminal of the capacitor C7 is coupled to the second ground voltage. The resistor R6 is connected to the capacitor C7 in parallel. When the modulation signal Vac' forms the pulse, the energy is transmitted through the transformer TR1 to charge the capacitor C7, so as to maintain a voltage of the capacitor C7 to a certain voltage value.

When the modulation signal Vac' does not form the pulse, no energy is transmitted through the transformer TR1, and now the capacitor C7 is discharged through the resistor R6, so that the voltage of the capacitor C7 is closed to the second ground voltage. According to the above description, the voltage of the capacitor C7 is maintained to a certain voltage value when the modulation signal Vac' forms the pulse, and is closed to the second ground voltage when the modulation signal Vac' does not form the pulse. Namely, the voltage of the capacitor C7 can form a pulse according to the modulation signal Vac', and a pulse width of the voltage of the capacitor C7 is closed to the pulse width of the modulation signal Vac'. The voltage of the capacitor C7 is taken as the regulation signal Dim, and is output to the current controller 230.

Moreover, the current controller 230 can perform a counting when the regulation signal Dim forms a pulse, so as to convert the pulse width of the regulation signal Dim into a digital value. Thereafter, the current controller 230 adjusts a magnitude of the current flowing through the LED string 50 according to the digital value.

Figure 3F:
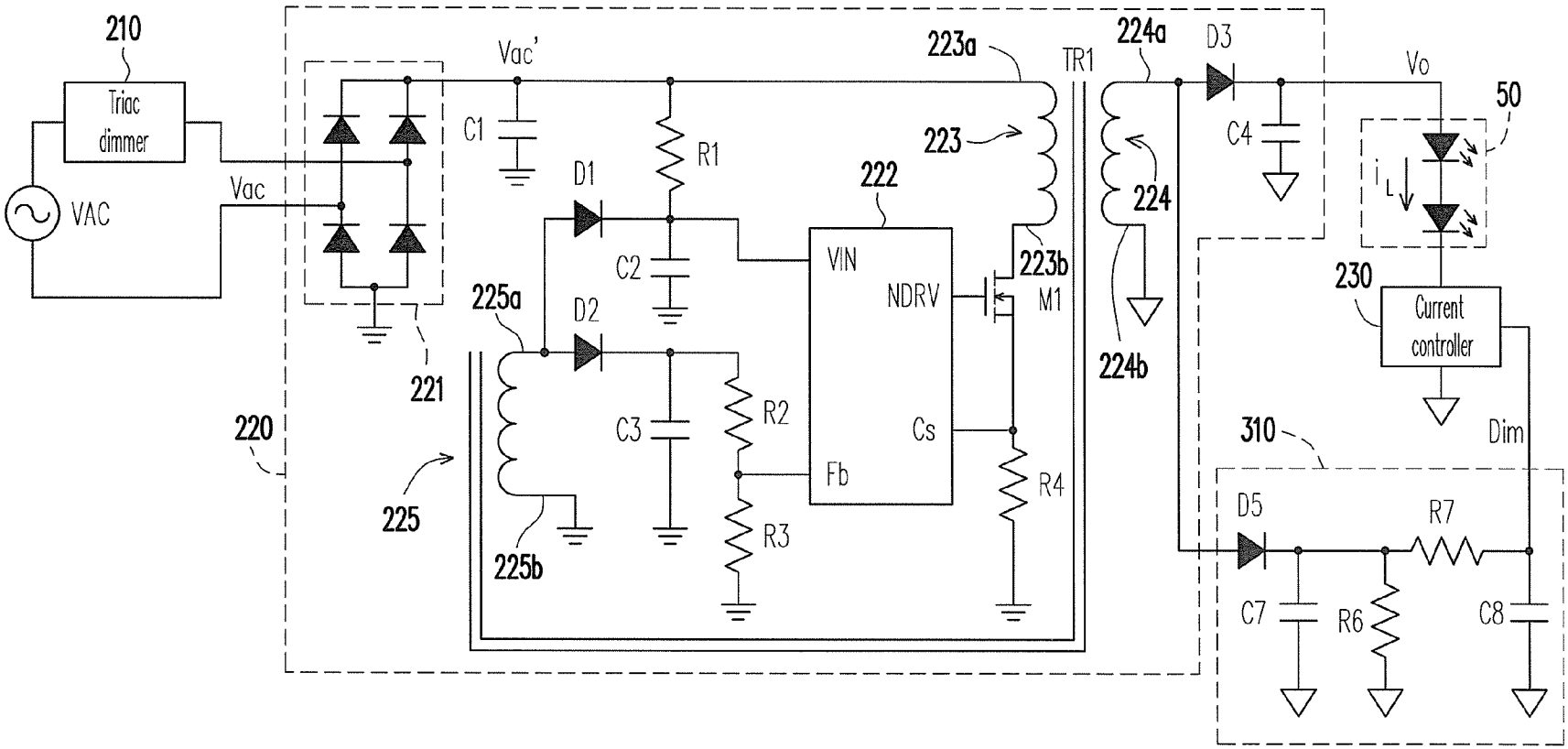
FIG. 3F is still another circuit diagram illustrating a dimmer circuit of FIG. 3A.

FIG. 3F is still another circuit diagram illustrating the dimmer circuit of FIG. 3A. Referring to FIG. 3E and FIG. 3F, a difference there between is that the pulse width detector 310 further includes a capacitor C8 and a resistor R7. The resistor R7 is coupled between the first terminal of the capacitor C7 and the current controller 230. The capacitor C8 is coupled between the current controller 230 and the second ground voltage. Wherein, the capacitor C8 and the resistor R7 can be regarded as a low pass filter (LPF), which is used for convert the pulse of the voltage of the capacitor C7 into a DC voltage to serve as the regulation signal Dim. Thereafter, the current controller 230 adjusts a magnitude of the current flowing through the LED string 50 according to the DC voltage.

Figure 4:
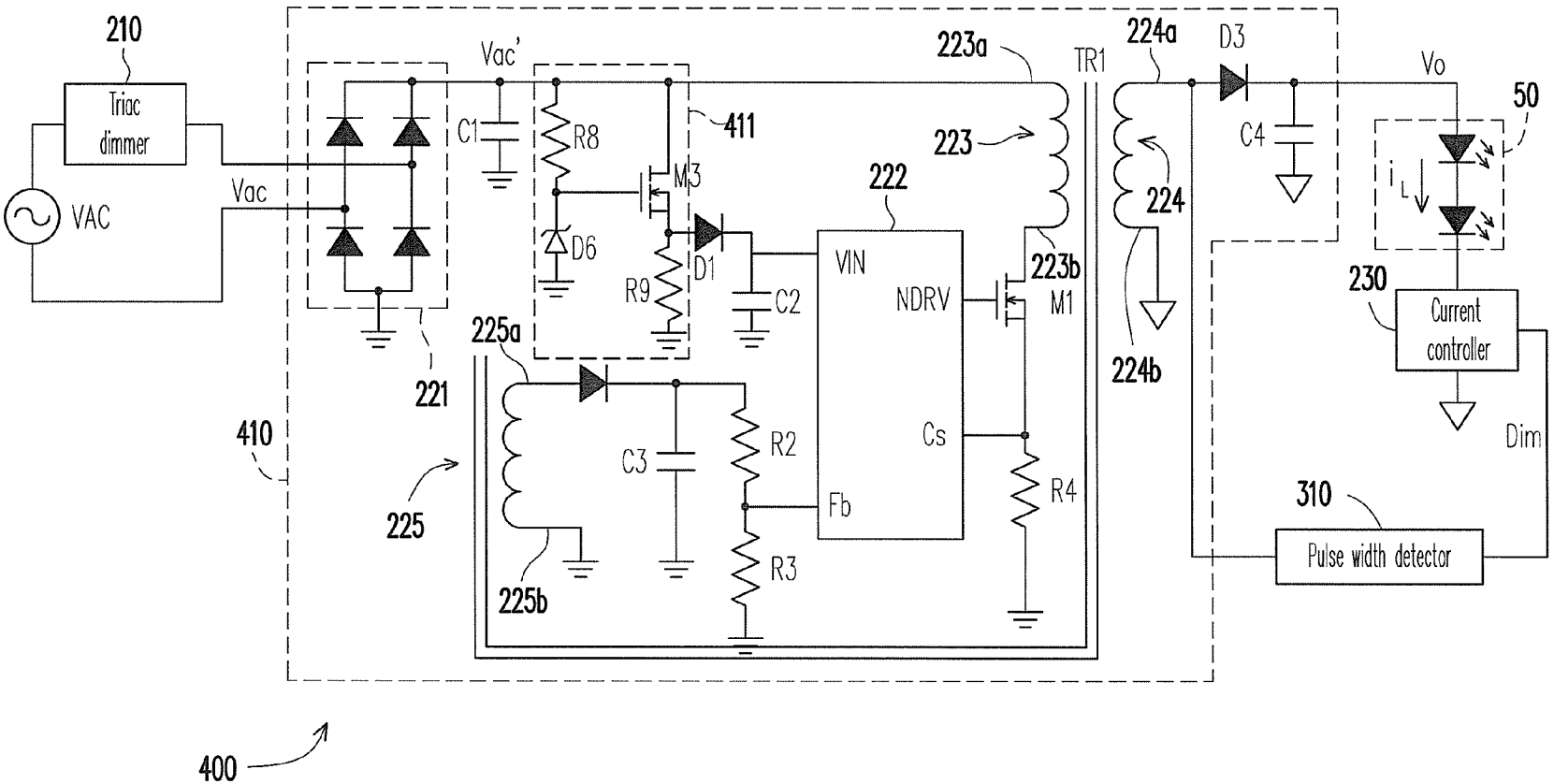
FIG. 4 is a system schematic diagram illustrating a dimmer circuit according to another embodiment of the present invention.

FIG. 4 is a system schematic diagram illustrating a dimmer circuit according to another embodiment of the present invention. Referring to FIG. 3B and FIG. 4, a difference there between is that an isolated voltage generator 410 of the dimmer circuit 400 includes a regulation circuit 411. The regulation circuit 410 includes a transistor M3, resistors R8 and R9, and a zener diode D6. A drain of the transistor M3 is coupled to the rectifier 221, and a source of the transistor M3 is coupled to the anode of the diode D1. The resistor R8 is coupled between the rectifier 221 and a gate of the transistor M3. A cathode of the zener diode D6 is coupled to the gate of the transistor M3, and an anode of the zener diode D6 is coupled to the first ground voltage. The resistor R9 is coupled between the source of the transistor M3 and the first ground voltage.

Here, a zener voltage of the zener diode D6 is, for example, 5V, so that a voltage received by the input terminal VIN of the controller 222 is about 5V minus a voltage between the gate and the source of the transistor M3 and further minus a forward bias of the diode D1. Namely, when the voltage of the modulation signal Vac' is greater than 5V, the voltage received by the input terminal VIN of the controller 222 is maintained to $5V-V_{GS}-0.7$. Since the regulation circuit 410 is not coupled to the third side winding of the transformer TR1, feedback of the energy stored in the transformer TR1 to the input terminal VIN of the controller 222 can be avoided. In other words, a transient conduction of the controller 222 can be avoided, and a transient lightening of the LED string 50 caused by the energy transmitted by the transformer TR1 when the controller 222 is conducted can be avoided.

Figure 5:
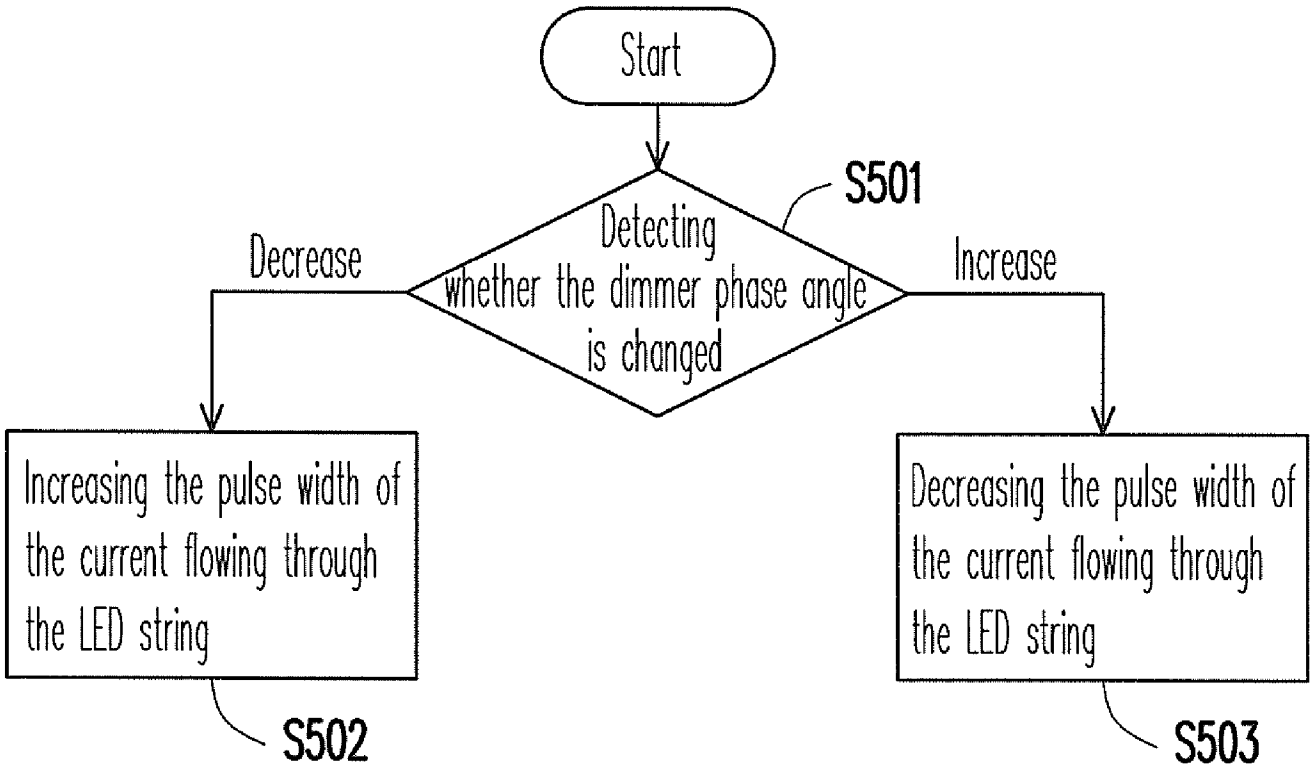
FIG. 5 is a flowchart illustrating a dimmer method according to an embodiment of the present invention.

According to the above descriptions, a dimmer method of the LED is provided, which is adapted to the aforementioned dimmer circuit 200. FIG. 5 is a flowchart illustrating a dimmer method according to an embodiment of the present invention. Referring to FIG. 2B and FIG. 5, first, it is detected whether the dimmer phase angle of the triac dimmer 210 is changed (step S501). When the dimmer phase angle of the triac dimmer 210 is decreased, the pulse width of the modulation signal Vac' is increased. Moreover, the pulse width of the driving signal Vo is correspondingly increased to increase the pulse width of the current $i_L$, flowing through the LED string 50 (step S502). When the dimmer phase angle of the triac dimmer 210 is increased, the pulse width of the modulation signal Vac' is decreased. Moreover, the pulse width of the driving signal Vo is correspondingly decreased to decrease the pulse width of the current $i_L$ flowing through the LED string 50 (step S503). Wherein, a voltage forming the modulation signal Vac' is isolated to a voltage forming the driving signal Vo. Namely, a current loop forming the modulated signal Vac' and a current loop forming the driving signal Vo have no common path.

Figure 6:
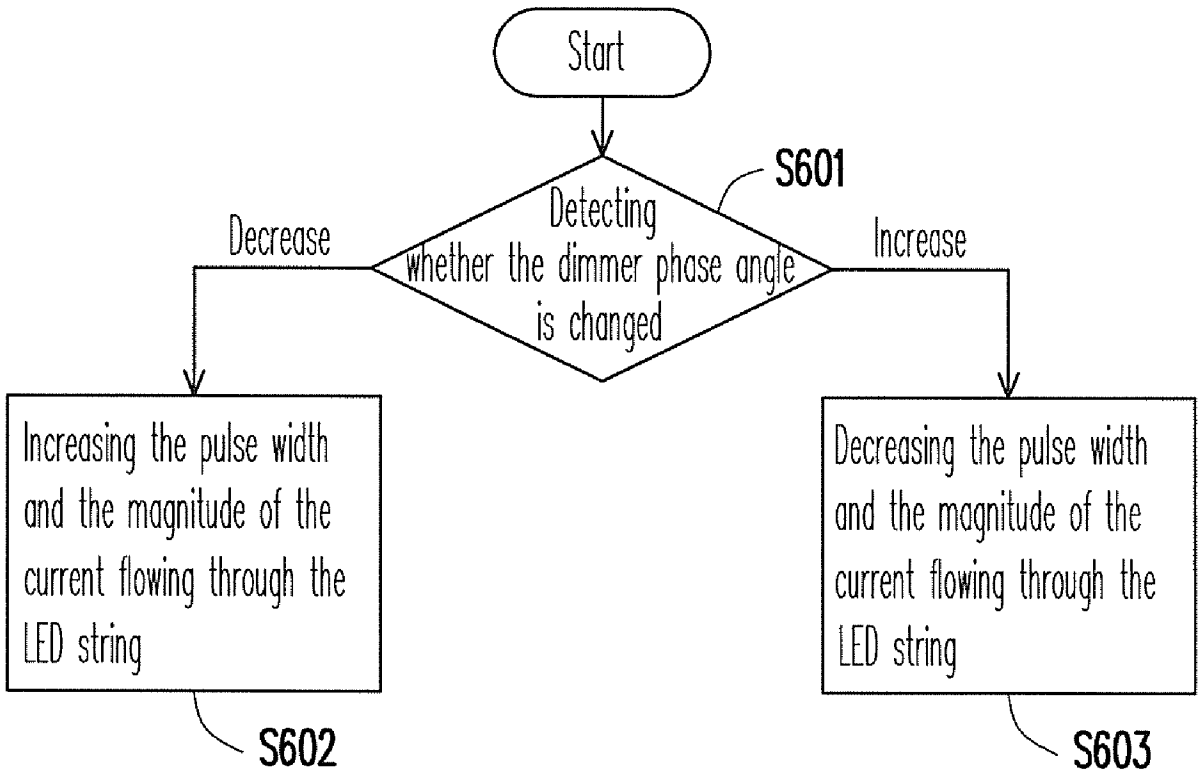
FIG. 6 is a flowchart illustrating a dimmer method according to another embodiment of the present invention.

Moreover, another dimmer method of the LED is provided, which is adapted to the aforementioned dimmer circuit 300. FIG. 6 is a flowchart illustrating a dimmer method according to another embodiment of the present invention. Referring to FIG. 5 and FIG. 6, differences there between lie on steps S602 and S603. When the dimmer phase angle of the triac dimmer 210 is decreased, the pulse width of the modulation signal Vac' is increased. Moreover, the pulse width of the driving signal Vo is correspondingly increased to increase the pulse width and a magnitude of the current $i_L$ flowing through the LED string 50 (step S602). When the dimmer phase angle of the triac dimmer 210 is increased, the pulse width of the modulation signal Vac' is decreased. Moreover, the pulse width of the driving signal Vo is correspondingly decreased to decrease the pulse width and the magnitude of the current $i_L$ flowing through the LED string 50 (step S603).

In summary, in the isolated voltage generator of the present invention, the pulse width of the modulation signal is fed back through the transformer having three sides, and the pulse width of the driving signal is regulated according to the pulse width of the modulation signal. By such means, a current forming the modulation signal can be isolated to a current forming the driving signal. In the LED dimmer circuit and the dimmer method thereof, the pulse width and the magnitude of the current flowing through the LED string are regulated according to the dimmer phase angle of the triac dimmer. By such means, a dimmer range of the LED can be increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An isolated voltage generator adapted to a light-emitting diode (LED) dimmer circuit, the LED dimmer circuit having a triac dimmer, and the isolated voltage generator comprising:

a rectifier, receiving a first voltage modulated by the triac dimmer;

a controller, having an input terminal, a driving output terminal, a feedback terminal and a current sensing terminal, the controller generating a control signal according to voltages received by the feedback terminal and the current sensing terminal, and outputting the control signal through the driving output terminal;

a transformer, having a first side winding, a second side winding and a third side winding, wherein a first terminal of the first side winding is coupled to the rectifier, a first terminal of the second side winding outputs a driving signal, a second terminal of the second side winding is coupled to a second ground voltage, and the third side winding is coupled between the input terminal of the controller and a first ground voltage;

a switch, having a control terminal, a first terminal and a second terminal, the control terminal of the switch being coupled to the driving output terminal of the controller, the first terminal of the switch being coupled to a second terminal of the first side winding, and the second terminal of the switch being coupled to the current sensing terminal of the controller;

a voltage divider, coupled among a first terminal of the third side winding of the transformer, the feedback terminal of the controller and the first ground voltage, for providing a divided voltage to the feedback terminal of the controller; and a first resistor, coupled between the current sensing terminal of the controller and the first ground voltage.

2. The isolated voltage generator as claimed in claim 1, further comprising a first capacitor coupled between the first terminal of the second side winding and the second ground voltage.

3. The isolated voltage generator as claimed in claim 1, wherein the voltage divider comprises:

a second resistor, coupled to the first terminal of the third side winding and the feedback terminal of the controller; and a third resistor, coupled between the feedback terminal of the controller and the first ground voltage.

4. The isolated voltage generator as claimed in claim 1, wherein the switch is a transistor.

5. The isolated voltage generator as claimed in claim 1, wherein the rectifier is a bridge rectifier.

6. The isolated voltage generator as claimed in claim 1, wherein the first voltage is an alternating current (AC) voltage.

7. The isolated voltage generator as claimed in claim 1, further comprising a regulation circuit coupled to the controller.

8. The isolated voltage generator as claimed in claim 7, wherein the regulation circuit comprises:

a transistor, having a first terminal coupled to the rectifier, and a second terminal coupled to the controller;

a fourth resistor, coupled between a control terminal of the transistor and the rectifier;

a fifth resistor, coupled between the second terminal of the transistor and the first ground voltage; and a diode, coupled between the control terminal of the transistor and the first ground voltage.

9. An LED dimmer circuit, comprising:

a triac dimmer, receiving a first voltage, and modulating the first voltage according to a dimmer phase angle;

an isolated voltage generator, coupled to the triac dimmer, and generating a driving signal according to the modulated first voltage, so as to drive at least one LED, wherein the first voltage and a voltage forming the driving signal are mutually isolated; and a current controller, controlling a current flowing through the LED according to a regulation signal, the current controller comprising:

a voltage controller, having signal adjusting terminal and a driving output terminal, the signal adjusting terminal of the voltage controller receiving the regulation signal for adjusting a voltage of the driving output terminal of the voltage controller according to the regulation signal;

a switch, having a control terminal, a first terminal and a second terminal, wherein the control terminal of the switch is coupled to the driving output terminal of the voltage controller, the second terminal of the switch is coupled to a second ground voltage, and whether the switch is conducted is determined according to the voltage of the driving output terminal of the voltage controller;

an inductor, coupled between the first terminal of the switch and the LED; and a diode, coupled between the isolated voltage generator and the first terminal of the switch.

10. The LED dimmer circuit as claimed in claim 9, wherein the isolated voltage generator comprises:

a rectifier, coupled to the triac dimmer for receiving the modulated first voltage;

a controller, having an input terminal, a driving output terminal, a feedback terminal and a current sensing terminal, the controller generating a control signal according to voltages received by the feedback terminal and the current sensing terminal, and outputting the control signal through the driving output terminal;

a transformer, having a first side winding, a second side winding and a third side winding, wherein a first terminal of the first side winding is coupled to the rectifier, a first terminal of the second side winding outputs the driving signal, a second terminal of the second side winding is coupled to a second ground voltage, and the third side winding is coupled between the input terminal of the controller and a first ground voltage;

a first switch, having a control terminal, a first terminal and a second terminal, the control terminal of the first switch being coupled to the driving output terminal of the controller, the first terminal of the first switch being coupled to a second terminal of the first side winding, and the second terminal of the first switch being coupled to the current sensing terminal of the controller;

a voltage divider, coupled among a first terminal of the third side winding of the transformer, the feedback terminal of the controller and the first ground voltage, for providing a divided voltage to the feedback terminal of the controller; and a first resistor, coupled between the current sensing terminal of the controller and the first ground voltage.

11. The LED dimmer circuit as claimed in claim 10, wherein the isolated voltage generator further comprises a first capacitor coupled between the first terminal of the second side winding and the second ground voltage.

12. The LED dimmer circuit as claimed in claim 10, wherein the voltage divider comprises:

a second resistor, coupled to the first terminal of the third side winding and the feedback terminal of the controller; and a third resistor, coupled between the feedback terminal of the controller and the first ground voltage.

13. The LED dimmer circuit as claimed in claim 10, wherein the first switch is a transistor.

14. The LED dimmer circuit as claimed in claim 10, wherein the rectifier is a bridge rectifier.

15. The LED dimmer circuit as claimed in claim 10, wherein the isolated voltage generator further comprises a regulation circuit coupled to the controller.

16. The LED dimmer circuit as claimed in claim 15, wherein the regulation circuit comprises:

a transistor, having a first terminal coupled to the rectifier, and a second terminal coupled to the controller;

a fourth resistor, coupled between a control terminal of the transistor and the rectifier;

a fifth resistor, coupled between the second terminal of the transistor and the first ground voltage; and a first diode, coupled between the control terminal of the transistor and the first ground voltage.

17. The LED dimmer circuit as claimed in claim 10, further comprising:

a pulse width detector, coupled to the isolated voltage generator for detecting a pulse width of the driving signal, so as to generate the regulation signal.

18. The LED dimmer circuit as claimed in claim 17, wherein the pulse width detector comprises:

a second capacitor, having a first terminal coupled to the isolated voltage generator and the current controller, and a second terminal coupled to the second ground voltage; and a sixth resistor, connected to the second capacitor in parallel.

19. The LED dimmer circuit as claimed in claim 18, wherein the pulse width detector further comprises:

a third capacitor, coupled between the current controller and the second ground voltage; and a seventh resistor, coupled between the first terminal of the second capacitor and the current controller.

20. The LED dimmer circuit as claimed in claim 9, wherein the current controller is a buck converter or a buck-boost converter.

21. The LED dimmer circuit as claimed in claim 9, wherein the triac dimmer comprises:

a tri-electrode AC switch (TRIAC), having a first terminal receiving the first voltage, and a second terminal coupled to the isolated voltage generator;

an eighth resistor, having a first terminal coupled to the first voltage;

a diode for alternating current (DIAC), coupled between a control terminal of the TRIAC and a second terminal of the eighth resistor; and a fourth capacitor, coupled between the second terminal of the eighth resistor and the isolated voltage generator.

22. The LED dimmer circuit as claimed in claim 9, wherein the first voltage is an AC voltage.

23. A dimmer method of an LED, adapted to an LED dimmer circuit, a triac dimmer of the LED dimmer circuit modulating an AC voltage according to a dimmer phase angle, an isolated voltage generator of the LED dimmer circuit generating a driving signal according to the modulated AC voltage, so as to drive at least one LED, and a current controller of the LED dimmer circuit controlling a current flowing through the LED, the dimmer method comprising:

increasing a pulse width of the modulated AC voltage when the dimmer phase angle is decreased, and correspondingly increasing a pulse width of the driving signal so as to increase a pulse width of the current flowing through the LED, wherein a voltage forming the modulated AC voltage and a voltage forming the driving signal are mutually isolated; and decreasing the pulse width of the modulated AC voltage when the dimmer phase angle is increased, and correspondingly decreasing the pulse width of the driving signal so as to decrease the pulse width of the current flowing through the LED.

24. The dimmer method of the LED as claimed in claim 23, wherein the LED dimmer circuit further comprises a pulse width detector for generating a regulation signal according to the pulse width of the driving signal, and the current controller regulates a current flowing through the LED according to the regulation signal.

25. The dimmer method of the LED as claimed in claim 24, further comprising:

increasing a magnitude of the current flowing through the LED when the dimmer phase angle is decreased; and decreasing a magnitude of the current flowing through the LED when the dimmer phase angle is increased.

* * * * *